US009890528B1

(12) United States Patent
Ashby

(10) Patent No.: US 9,890,528 B1
(45) Date of Patent: Feb. 13, 2018

(54) AUTOMATIC TOILET FLUSH DEVICE

(71) Applicant: Kendall Ashby, Clearfield, UT (US)

(72) Inventor: Kendall Ashby, Clearfield, UT (US)

( * ) Notice: Subject to any disclaimer, the term of this patent is extended or adjusted under 35 U.S.C. 154(b) by 0 days.

(21) Appl. No.: 15/291,733

(22) Filed: Oct. 12, 2016

(51) Int. Cl.
*E03D 1/00* (2006.01)
*E03D 5/10* (2006.01)
*A47K 13/24* (2006.01)

(52) U.S. Cl.
CPC ..... *E03D 5/105* (2013.01); *A47K 13/24* (2013.01); *E03D 5/10* (2013.01)

(58) Field of Classification Search
CPC ..... E03D 5/10; E03D 5/105; A47K 13/24
USPC ..... 4/313
See application file for complete search history.

(56) References Cited

U.S. PATENT DOCUMENTS 536,981 A 4/1895 Wiswall et al.
4,831,670 A 5/1989 Velazquez
5,455,971 A 10/1995 Sakakibara et al.
5,603,127 A 2/1997 Veal
5,652,968 A 8/1997 Koaira
D393,627 S 4/1998 Veal
6,028,520 A * 2/2000 Maehre ..... A47K 13/24 340/522
6,618,864 B2 * 9/2003 Veal ..... A47K 13/10 4/313
7,032,256 B2 * 4/2006 Contadini ..... E03D 5/09 4/406
7,500,277 B2 3/2009 Bush
8,370,969 B2 * 2/2013 Bowcutt ..... E03D 11/00 4/313
8,561,225 B2 10/2013 Wilson et al.
2015/0074893 A1 * 3/2015 Veros ..... E03D 5/105 4/313
2016/0145844 A1 * 5/2016 Veros ..... E03D 5/105 4/313

* cited by examiner

*Primary Examiner* — Huyen Le
(74) *Attorney, Agent, or Firm* — Stevenson IP, LLC

(57) ABSTRACT

An automatic toilet flush device including a weight sensor between a toilet bowl rim and a toilet seat and a capacitive touch plate disposed on the toilet lid, both of which are configured to automatically flush a toilet either when someone sits on the toilet seat or touches the capacitive touch plate, respectively. The weight sensor is in operational communication with a sensing module transmitter which in wireless communication with a flush module receiver in operational communication with a microprocessor disposed within a housing inside the toilet tank. The capacitive touch plate is also in operational communication with the microprocessor, to which a timer is connected to permit flushing after a pre-determined time. When the microprocessor activates the flush module receiver, the flush motor activates an arm on a flush lever which, in turn, controls the flush valve to flush the toilet and to re-fill the toilet bowl.

1 Claim, 6 Drawing Sheets

AUTOMATIC TOILET FLUSH DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of toilet flushing devices are known in the prior art. However, what is needed, and what the present device provides, is an automatic toilet flush device including a weight sensor between a toilet bowl rim and a toilet seat and a capacitive touch plate disposed on the toilet lid, both of which are configured to automatically flush a toilet either when someone sits on the toilet seat or touches the capacitive touch plate, respectively. The weight sensor is in operational communication with a sensing module transmitter which in in wireless communication with a flush module receiver in operational communication with a microprocessor disposed within a housing inside the toilet tank. The capacitive touch plate is also in operational communication with the microprocessor, to which a timer is connected to permit flushing after a pre-determined time. When the microprocessor activates the flush module receiver, the flush motor activates an arm on a flush lever which, in turn, controls the flush valve to flush the toilet and to re-fill the toilet bowl.

FIELD OF THE INVENTION

The present invention relates toilet flushing devices, and more particularly, to an automatic toilet flush device.

SUMMARY OF THE INVENTION

The general purpose of the present automatic toilet flush device, described subsequently in greater detail, is to provide an automatic toilet flush device which has many novel features that result in an automatic toilet flush device which is not anticipated, rendered obvious, suggested, or even implied by prior art, either alone or in combination thereof. To accomplish this, the present automatic toilet flush device is provided to flush a toilet without the presence of a manually-operated handle lever. The present device includes a flush valve disposed on a bottom end of a toilet tank of a toilet and a flush lever, within the toilet tank, which is in operational communication with the flush valve. A flush motor is disposed within the toilet tank and is in operational communication with the flush lever. A flush module receiver, disposed within a tank of the toilet, is in operational communication with the flush motor. A microprocessor, disposed within an impermeable housing, is in operational communication with the flush module receiver. A timer, disposed on the microprocessor, is in operational communication with the microprocessor. A capacitive touch plate within a lid of the toilet is in operational communication with the microprocessor. A sensing module transmitter, disposed on a rear portion of a toilet bowl of a toilet, is in operational communication with the flush valve. The sensing module transmitter is further in wireless operational communication with the flush module receiver. A weight sensor, disposed on an upper rim of the toilet bowl, is in operational communication with the sensing module transmitter. At least one battery is disposed within the toilet bowl to provide a power source to the sensing module transmitter. When the weight sensor detects weight thereon in addition to a weight of a toilet seat which is atop the weight sensor when the toilet seat is down and, alternately, when the capacitive touch plate is activated, the weight sensor activates the sensing module transmitter. Upon activation of the sensing module transmitter, the sensing module transmitter activates the flush module receiver. Subsequent to a predetermined time set on the timer from a deactivation of the weight sensor and, alternately, subsequent to the activation of the capacitive touch plate, the microprocessor activates the flush motor receiver and then the flush motor receiver activates the flush motor. Upon activation of the flush motor, the flush motor lifts an arm on the flush lever. Upon the lifting of the arm, the flush valve is opening, an water within the toilet bowl flows out and an amount of clean water from a water source flows into toilet bowl. Upon the proper filling of the toilet bowl with the clean water, the water flowing out of the toilet bowl enters and flows out of an S trap disposed underneath the toilet bowl. Thus has been broadly outlined the more important features of the present automatic toilet flush device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
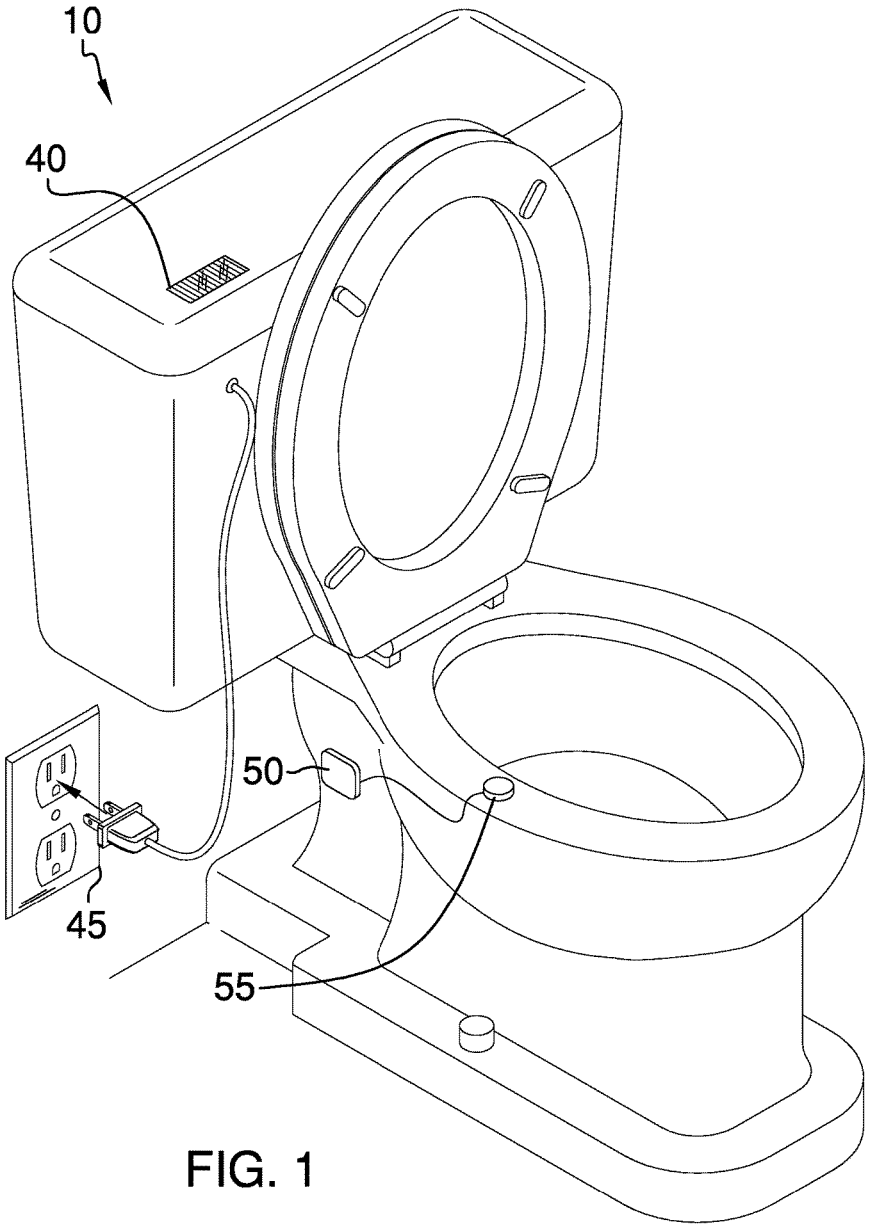
FIG. 1 is an isometric view.
Figure 2:
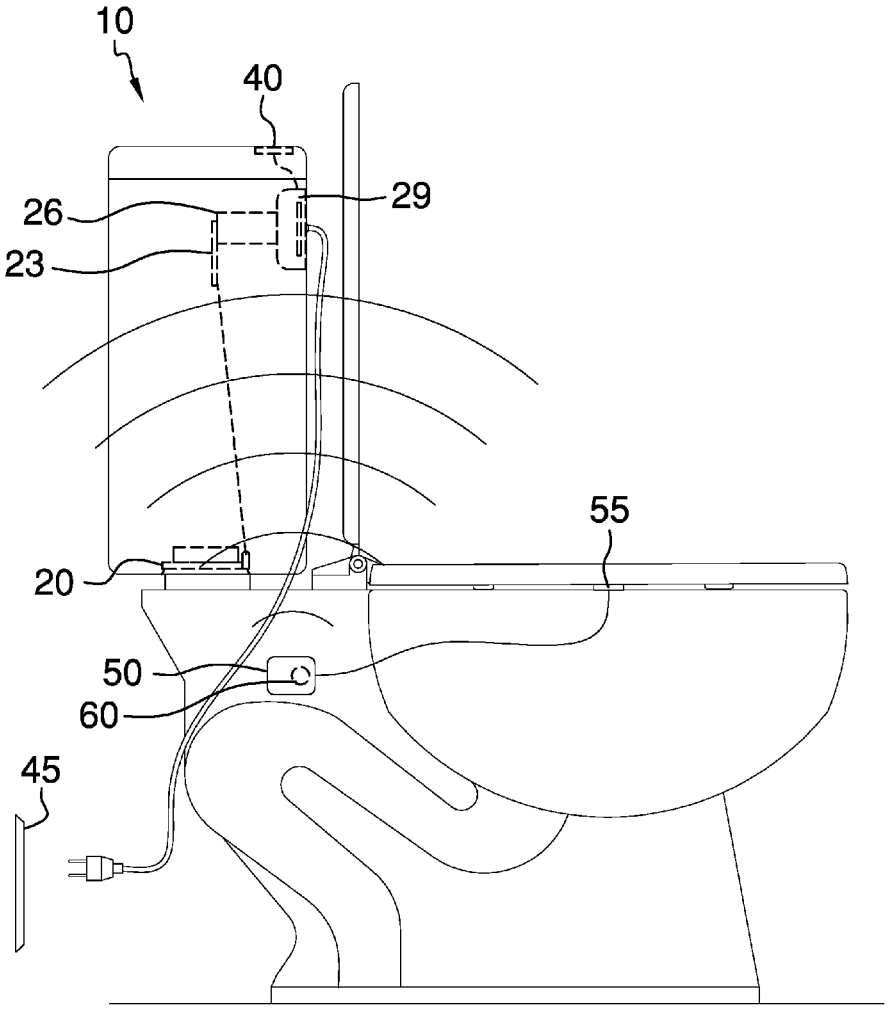
FIG. 2 is a side elevation view.
Figure 3:
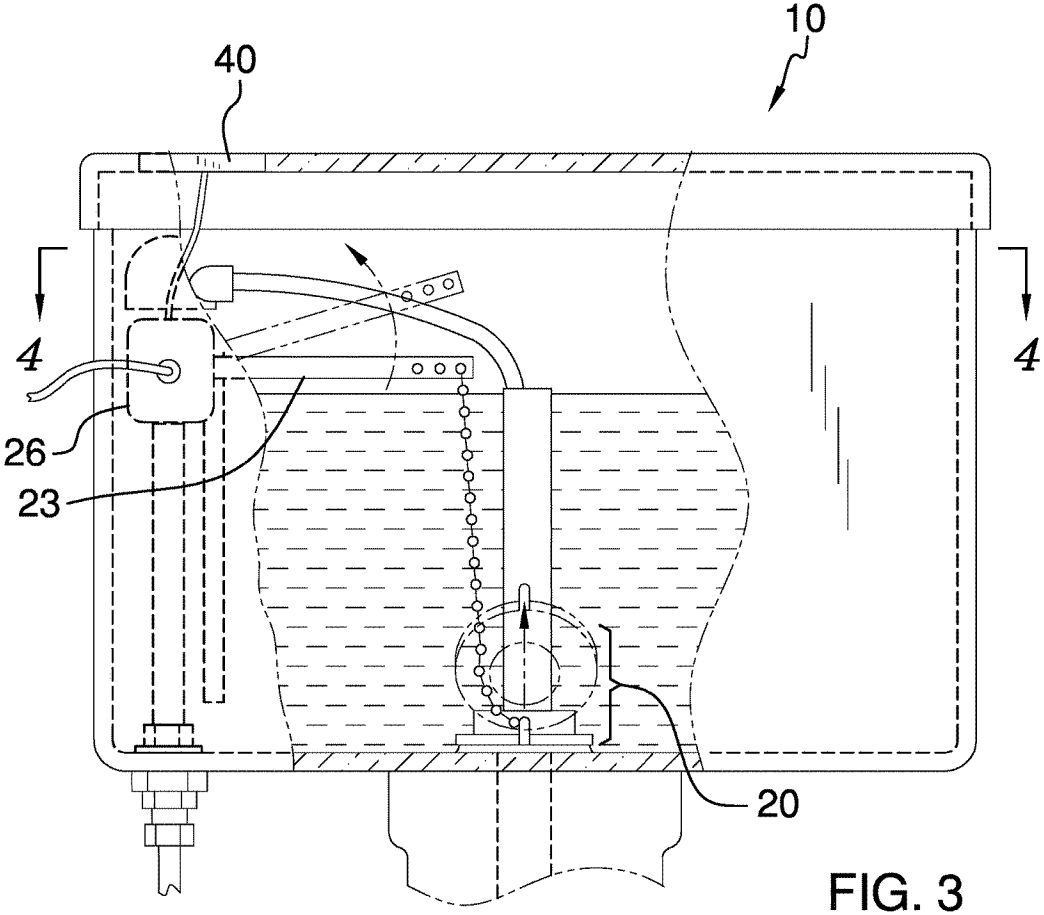
FIG. 3 is a front elevation view with a partial cutaway showing interworkings of a flush lever, a flush valve, and a capacitive touch plate.
Figure 4:
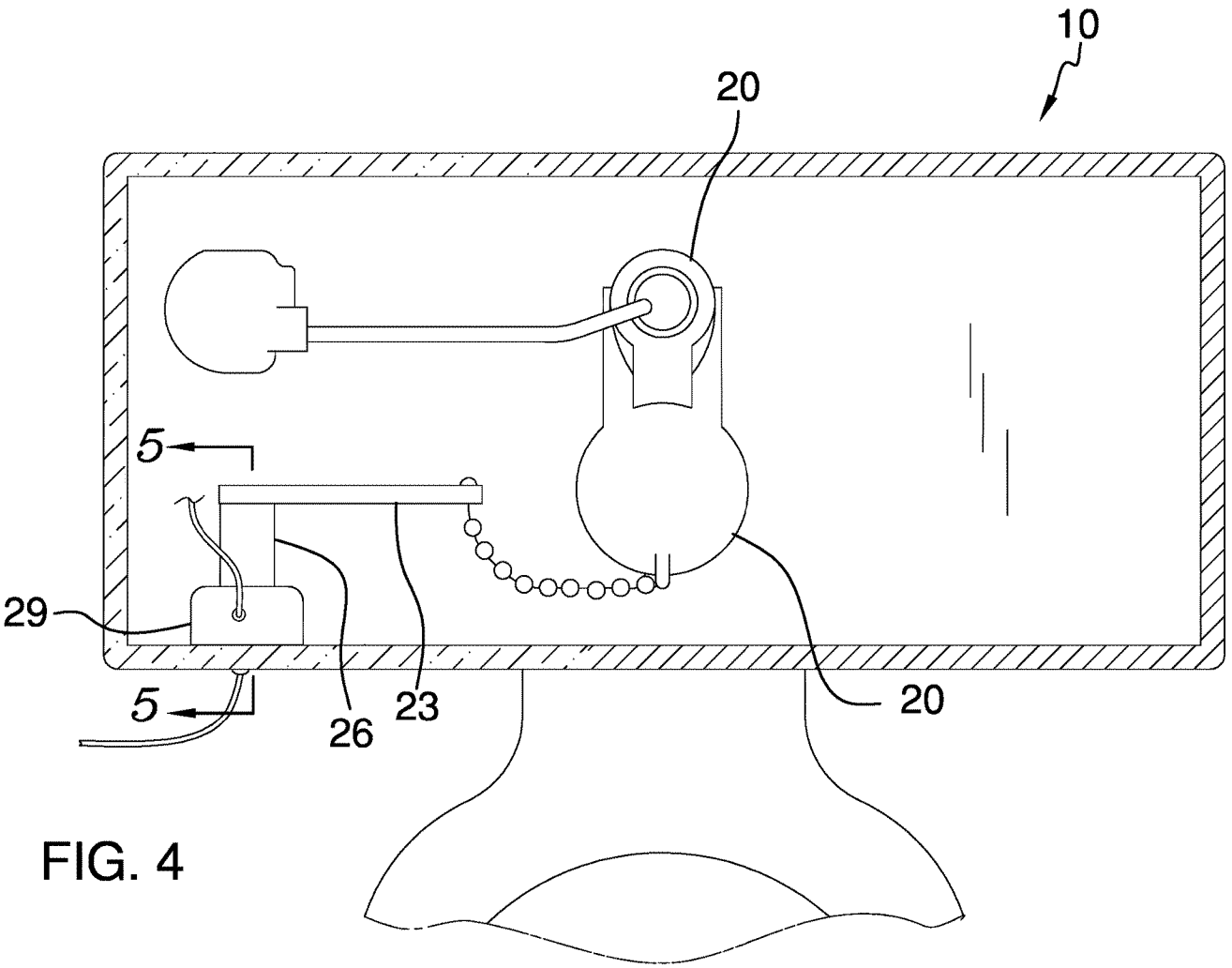
FIG. 4 is a cross-sectional view taken along line 4-4 of FIG. 3.
Figure 5:
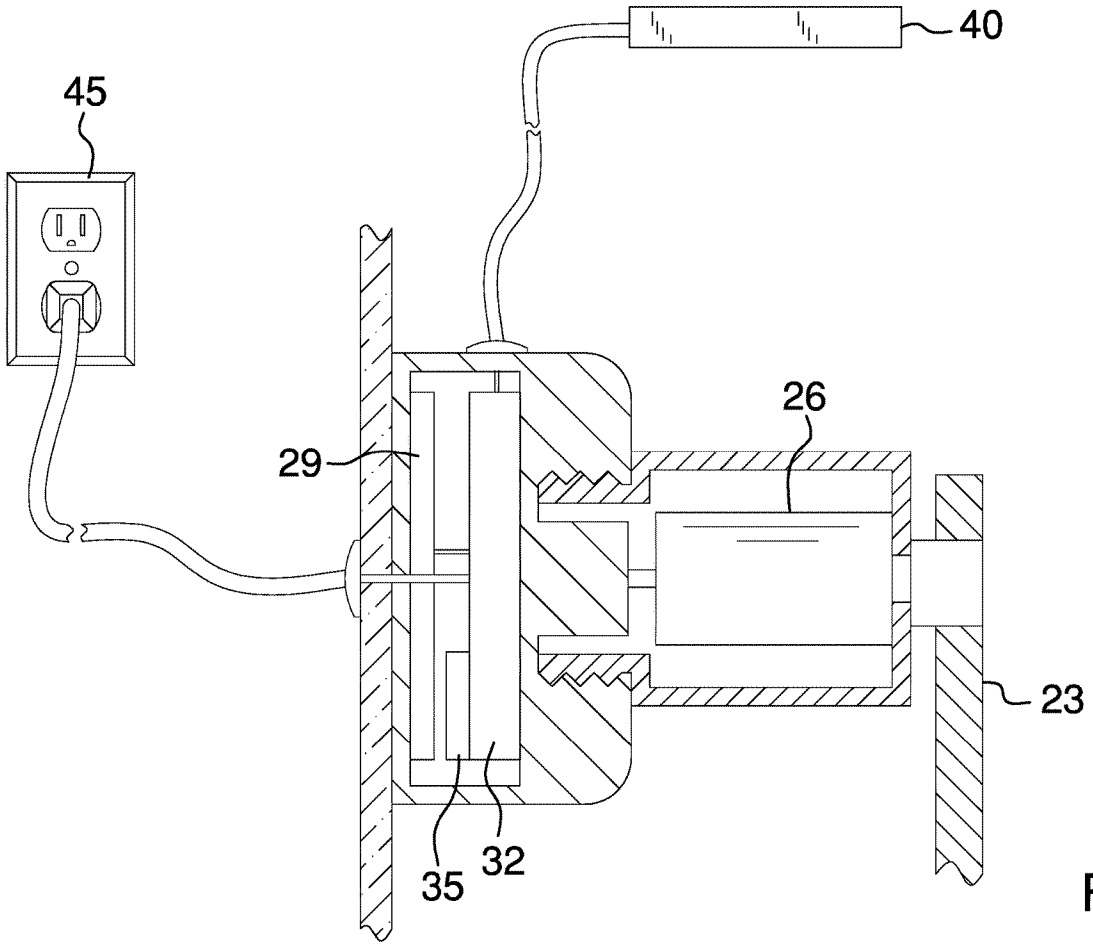
FIG. 5 is a cross-sectional view taken along line 5-5 of FIG. 4.
Figure 6:
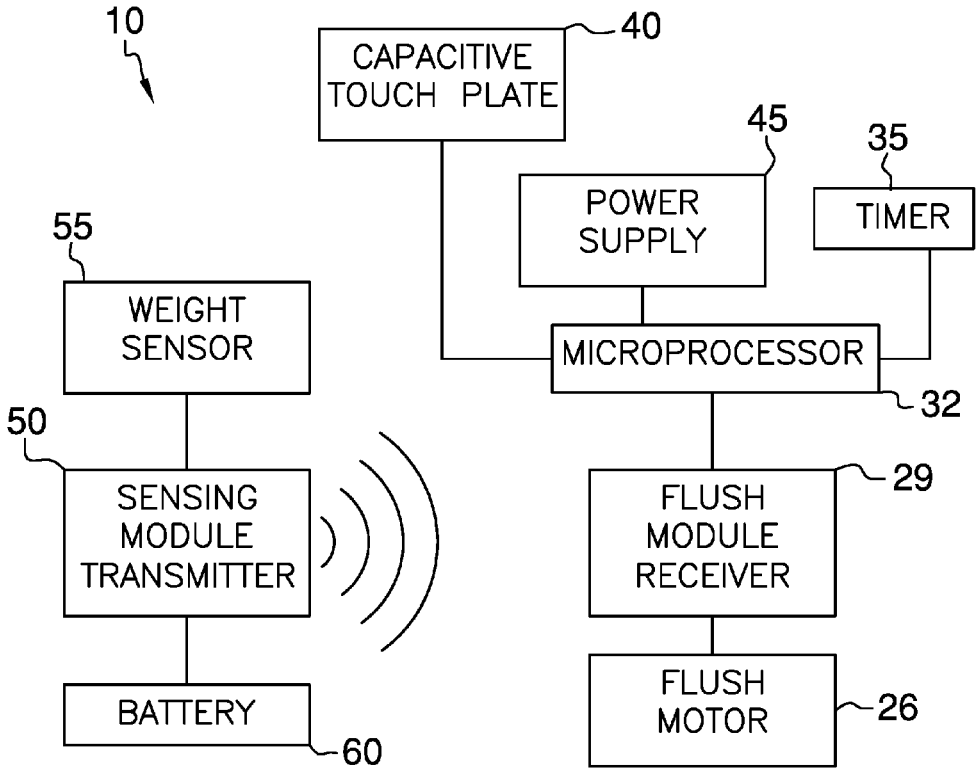
FIG. 6 is a block diagram of operations.

With reference now to the drawings, and in particular FIGS. 1 through 6 thereof, an example of the instant automatic toilet flush device employing the principles and concepts of the present automatic toilet flush device and generally designated by the reference number 10 will be described.

Referring to FIGS. 1 through 6 the present automatic toilet flush device 10 for use with either public toilets, such as toilets in restaurants, hospitals, and commercial structures, or residential toilets is illustrated. The automatic toilet flush device 10 includes a flush valve 20 disposed on a bottom end of a toilet tank of a toilet. A flush lever 23, disposed within the toilet tank, is in operational communication with the flush valve 20. A flush motor 26 is disposed within the toilet tank and in operational communication with the flush lever 23. A flush module receiver 29 is disposed within a tank of the toilet. The flush module receiver 29 is in operational communication with the flush motor 26. A microprocessor 32 is disposed within an impermeable housing 33. The microprocessor 32 is in operational communication with the flush module receiver 29. A timer 35 is disposed on the microprocessor 32, the timer 35 further is in operational communication with the microprocessor 32. A capacitive touch plate 40 is disposed within a lid of the toilet, the capacitive touch plate 40 is in operational communication with the microprocessor 32. The flush motor 26, the flush module receiver 29, the microprocessor 32, the timer 35, and the capacitive touch plate 40 are powered by a power supply 45. A sensing module transmitter 50 is disposed on a rear portion of a toilet bowl of a toilet, the toilet having a flush valve 20 and a flush lever 23 is disposed with a tank of the toilet, the flush lever 23 is in operational communication with the flush valve 20, the sensing module transmitter 50 is in wireless operational communication with the flush module receiver 29. A weight sensor 55 is disposed on an upper rim of the toilet bowl, the weight sensor 55 is in operational communication with the sensing module transmitter 50. At least one battery 60, disposed within the toilet bowl, is configured to provide a power source to the sensing module transmitter 50. When the weight sensor 55 detects weight thereon in addition to a weight of a toilet seat which is atop the weight sensor when the toilet seat is down and, alternately, when the capacitive touch plate 40 is activated, the weight sensor 55 activates the sensing module transmitter 50. Upon activation of the sensing module transmitter 50, the sensing module transmitter 50 activates the flush module receiver 29. Subsequent to a predetermined time set on the timer 35 from a deactivation of the weight sensor 55 and, alternately, subsequent to the activation of the capacitive touch plate 40, the microprocessor 32 activates the flush motor 26 receiver and then the flush motor 26 receiver activates the flush motor 26. Upon activation of the flush motor 26, the flush motor 26 lifts an arm 65 on the flush lever 23. Upon the lifting of the arm 65, the flush valve 20 is opening, and water within the toilet bowl flows out and an amount of clean water from a water source flows into toilet bowl. Upon the proper filling of the toilet bowl with the clean water, the water flowing out of the toilet bowl enters and flows out of an S trap disposed underneath the toilet bowl.

What is claimed is:

1. An automatic toilet flush device comprising:

a flush valve disposed on a bottom end of a toilet tank of a toilet;

a flush lever disposed within the toilet tank, the flush lever being in operational communication with the flush valve a flush motor being disposed within the toilet tank and in operational communication with the flush lever;

a flush module receiver disposed within a tank of the toilet, the flush module receiver being in operational communication with the flush motor;

a microprocessor disposed within an impermeable housing, the microprocessor being in operational communication with the flush module receiver;

a timer disposed on the microprocessor, the timer further being in operational communication with the microprocessor;

a capacitive touch plate disposed within a lid of the toilet, the capacitive touch plate being in operational communication with the microprocessor;

wherein the flush motor, the flush module receiver, the microprocessor, the timer, and the capacitive touch plate are powered by a power supply;

a sensing module transmitter disposed on a rear portion of a toilet bowl of a toilet, the toilet having a flush valve and a flush lever disposed with a tank of the toilet, the flush lever being in operational communication with the flush valve, the sensing module transmitter being in wireless operational communication with the flush module receiver;

a weight sensor disposed on an upper rim of the toilet bowl, the weight sensor being in operational communication with the sensing module transmitter;

at least one battery disposed within the toilet bowl, the battery configured to provide a power source to the sensing module transmitter;

wherein when the weight sensor detects weight disposed thereon in addition to the weight of a toilet seat disposed atop the weight sensor when the toilet seat is down and, alternately, when the capacitive touch plate is activated, the weight sensor activates the sensing module transmitter;

wherein upon activation of the sensing module transmitter, the sensing module transmitter activates the flush module receiver;

wherein subsequent to a predetermined time set on the timer from a deactivation of the weight sensor and, alternately, subsequent to the activation of the capacitive touch plate, the microprocessor activates the flush motor receiver and then the flush motor receiver activates the flush motor;

wherein upon activation of the flush motor, the flush motor lifts an arm on the flush lever;

wherein upon the lifting of the arm, the flush valve is opening, an water within the toilet bowl flows out and an amount of clean water from a water source flows into toilet bowl; and wherein upon the proper filling of the toilet bowl with the clean water, the water flowing out of the toilet bowl enters and flows out of an S trap disposed underneath the toilet bowl.

* * * * *